US007887306B2

(12) United States Patent
Lee

(10) Patent No.: US 7,887,306 B2
(45) Date of Patent: Feb. 15, 2011

(54) LINEAR COMPRESSOR

(75) Inventor: Hyo-jae Lee, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 29 days.

(21) Appl. No.: 12/048,329

(22) Filed: Mar. 14, 2008

(65) Prior Publication Data

US 2008/0226473 A1 Sep. 18, 2008

(30) Foreign Application Priority Data

Mar. 14, 2007 (KR) ..... 10-2007-0025244

(51) Int. Cl.
*F04B 35/00* (2006.01)

(52) U.S. Cl. ..... 417/363; 417/902

(58) Field of Classification Search ..... 417/638, 417/561, 363, 902; 248/363, 902, 638, 561
See application file for complete search history.

(56) References Cited

U.S. PATENT DOCUMENTS 3,887,304 A * 6/1975 Otaki et al. ..... 417/363
6,132,183 A * 10/2000 Li et al. ..... 417/363
7,124,678 B2 * 10/2006 Lee et al. ..... 92/140
2002/0172607 A1 * 11/2002 Kim ..... 417/366
2003/0175135 A1 * 9/2003 Heo et al. ..... 417/363
2006/0018771 A1 * 1/2006 Song et al. ..... 417/416
2006/0216165 A1 * 9/2006 Lee ..... 417/363
2007/0001519 A1 * 1/2007 Jeong et al. ..... 310/12

* cited by examiner

*Primary Examiner*—Charles G Freay
*Assistant Examiner*—Todd D Jacobs
(74) *Attorney, Agent, or Firm*—KED & Associates, LLP

(57) ABSTRACT

The present invention discloses a linear compressor including a shell, a compressor main body installed in the shell and composed of a cylinder, a piston reciprocated inside the cylinder to compress refrigerant, and a linear motor for driving the piston, and elastic members spaced apart from the bottom of the shell to support the compressor main body inside the shell. In this configuration, since installation positions of the elastic members approach a gravity center of the compressor main body, a rotation moment imparted to the elastic members can be lowered and vibration of the compressor main body can be reduced.

15 Claims, 6 Drawing Sheets

LINEAR COMPRESSOR

TECHNICAL FIELD

The present invention relates to a linear compressor, and more particularly, to a linear compressor configured to reduce vibration.

BACKGROUND ART

In general, a compressor is a mechanical apparatus that receives power from a power generation apparatus such as an electric motor, a turbine or the like and compresses air, refrigerant or various operation gases to raise a pressure. The compressor has been widely used in an electric home appliance such as a refrigerator and an air conditioner, or in the whole industry.

The compressor is roughly classified into a reciprocating compressor wherein a compression space to/from which an operation gas is sucked and discharged is defined between a piston and a cylinder, and the piston is linearly reciprocated inside the cylinder to compress refrigerant, a rotary compressor wherein a compression space to/from which an operation gas is sucked and discharged is defined between an eccentrically-rotated roller and a cylinder, and the roller is eccentrically rotated along an inner wall of the cylinder to compress refrigerant, and a scroll compressor wherein a compression space to/from which an operation gas is sucked and discharged is defined between an orbiting scroll and a fixed scroll, and the orbiting scroll is rotated along the fixed scroll to compress refrigerant.

Recently, a linear compressor has been developed among the reciprocating compressors. In the linear compressor, a piston is coupled directly to a linearly-reciprocated driving motor to prevent a mechanical loss by motion conversion, improve the compression efficiency and simplify the configuration.

FIG. 1 illustrates one example of a linear compressor. Normally, in the linear compressor, a piston 4 is linearly reciprocated inside a cylinder 2 by a linear motor 10 in a hermetic shell 1 so as to suck, compress and discharge refrigerant. The linear motor 10 includes an inner stator 12, an outer stator 14 and a permanent magnet 16. The permanent magnet 16 is linearly reciprocated between the inner stator 12 and the outer stator 14 due to a mutual electromagnetic force. As the permanent magnet 16 is driven in a state where it is coupled to the piston 4, the piston 4 is linearly reciprocated inside the cylinder 2 to suck, compress and discharge refrigerant.

In addition, the linear compressor includes a frame 3 on which the cylinder 2 is installed, and further includes a motor cover 5 bolt-coupled to the frame 3. The linear motor 10 is installed between the frame 3 and the motor cover 5. Moreover, a back cover 6 is installed on the motor cover 5, and a spring 7 is elastically supported between a member connected to the piston 4 and the back cover 6.

Hereinafter, in order to simplify a vibration system of the linear compressor, the cylinder 2, the piston 4, the frame 3, the motor cover 5, the back cover 6, the spring 7, the linear motor 10, a passage of refrigerant, and members used to compress the refrigerant are referred to as a linear compressor main body 20.

Generally, the compressor main body 20 is spaced apart from the bottom of the shell 1 to prevent vibration generated by the motion of the piston 4 from being transferred directly to the shell 1. The compressor main body 20 is supported by elastic members 9 to be spaced apart from the bottom of the shell 1. Normally, the number of the elastic members 9 is four.

That is, one pair of elastic members 9 are installed at the front of the compressor main body 20, i.e., on the side of the frame 3, and the other pair of elastic members 9 are installed at the rear of the compressor main body 20, i.e., on the side of the back cover 6.

FIG. 2 is a schematic view illustrating the vibration system of the linear compressor.

A reaction force is imparted to the elastic members 9 due to the gravity of the compressor main body 20. A gravity center point G of the compressor main body 20 exists in a predetermined position inside the compressor main body 20. Accordingly, since installation points of the elastic members 9 are spaced apart from the gravity center point G of the compressor main body 20 by a predetermined distance r, a rotation moment is generated in the elastic members 9 due to the motion of the piston 4. When the elastic members 9 are vibrated due to the rotation moment, the compressor main body 20 supported by the elastic members 9 is vibrated. As a result, vibration and noise of the entire linear compressor are increased, and such vibration is transferred to a mount 30 for mounting the linear compressor on a system. Moreover, vibration is imparted to the system with the linear compressor mounted therein, so that vibration and noise of the system are increased.

DISCLOSURE OF THE INVENTION

Therefore, an object of the present invention is to reduce vibration of a linear compressor.

Another object of the present invention is to lower a rotation moment generated in a compressor main body and to thereby reduce vibration of a linear compressor.

A further object of the present invention is to reduce vibration of a compressor generated inside a shell and to thereby reduce vibration transferred to the outside of the shell.

According to one aspect of the present invention for achieving the above objects, there is provided a linear compressor, including: a compressor main body including a piston for compressing refrigerant and a linear motor for driving the piston; a shell for accommodating the compressor main body; a plurality of elastic members for supporting the compressor main body inside the shell; and lower supporters spaced apart from the bottom of the shell to support bottom ends of the elastic members. In this configuration, since an installation height of the bottom end of at least one of the plurality of elastic members approaches a gravity center of the compressor main body, a rotation moment is lowered and vibration of the compressor is reduced.

In addition, installation heights of the bottom ends of the plurality of elastic members are different from each other.

Moreover, the plurality of elastic members include front elastic members installed at the front of the compressor main body, and rear elastic members installed at the rear of the compressor main body, and any one of the front and rear elastic members is supported by the lower supporter.

The linear compressor further includes a terminal for applying power to the linear motor at the front of the shell, wherein the plurality of elastic members include front elastic members installed at the front of the compressor main body, and rear elastic members installed at the rear of the compressor main body, bottom ends of the front elastic members are supported by the bottom of the shell, and bottom ends of the rear elastic members are supported by the lower supporters. In this configuration, since a relatively larger shell space is defined at the rear of the compressor main body than at the front of the compressor main body, the space inside the shell can be efficiently used.

Further, the compressor main body includes upper supporters for supporting top ends of the plurality of elastic members, and a height of a gravity center of the compressor main body is positioned between heights of the lower supporters supporting the elastic members having the bottom ends installed in a high position and heights of the upper supporters.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

Hereinafter, preferred embodiments of the present invention will be described in detail with reference to the accompanying drawings.

Figure 1:
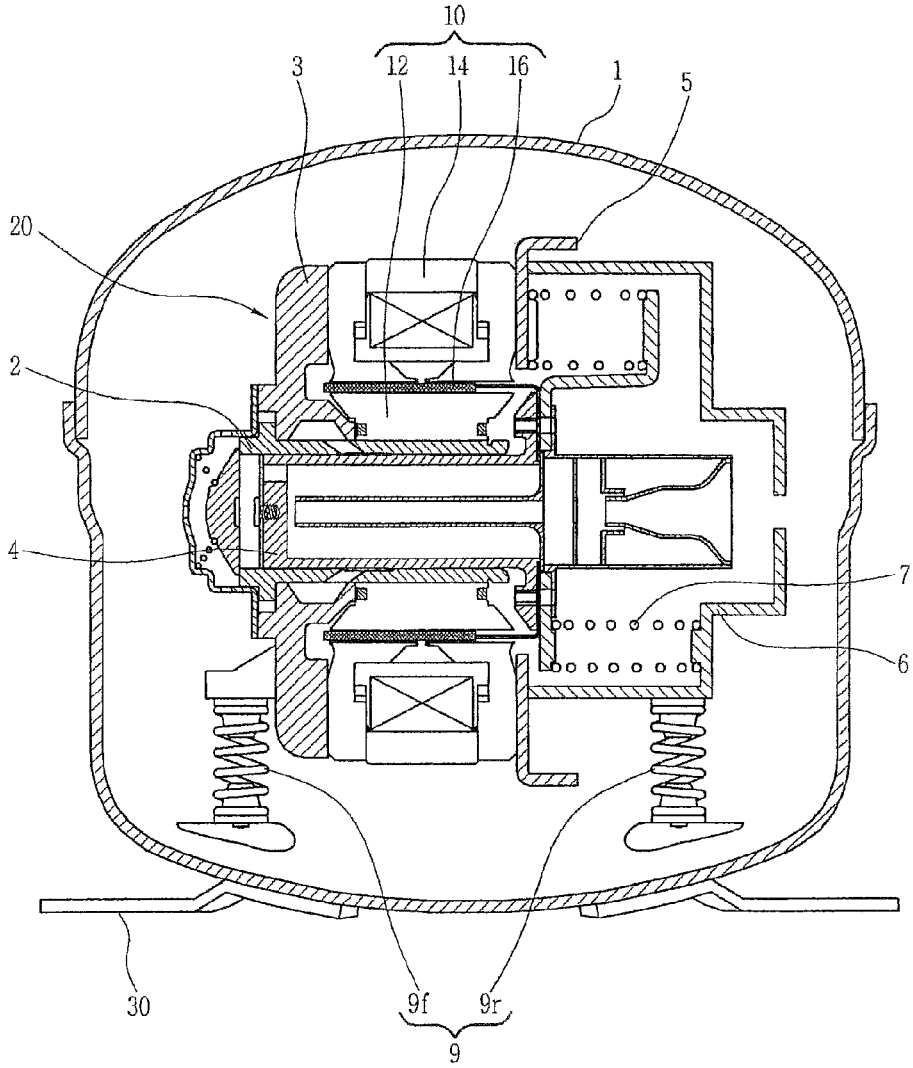
FIG. 1 PRIOR ART
FIG. 1 is a view illustrating one example of a conventional linear compressor.
Figure 2:
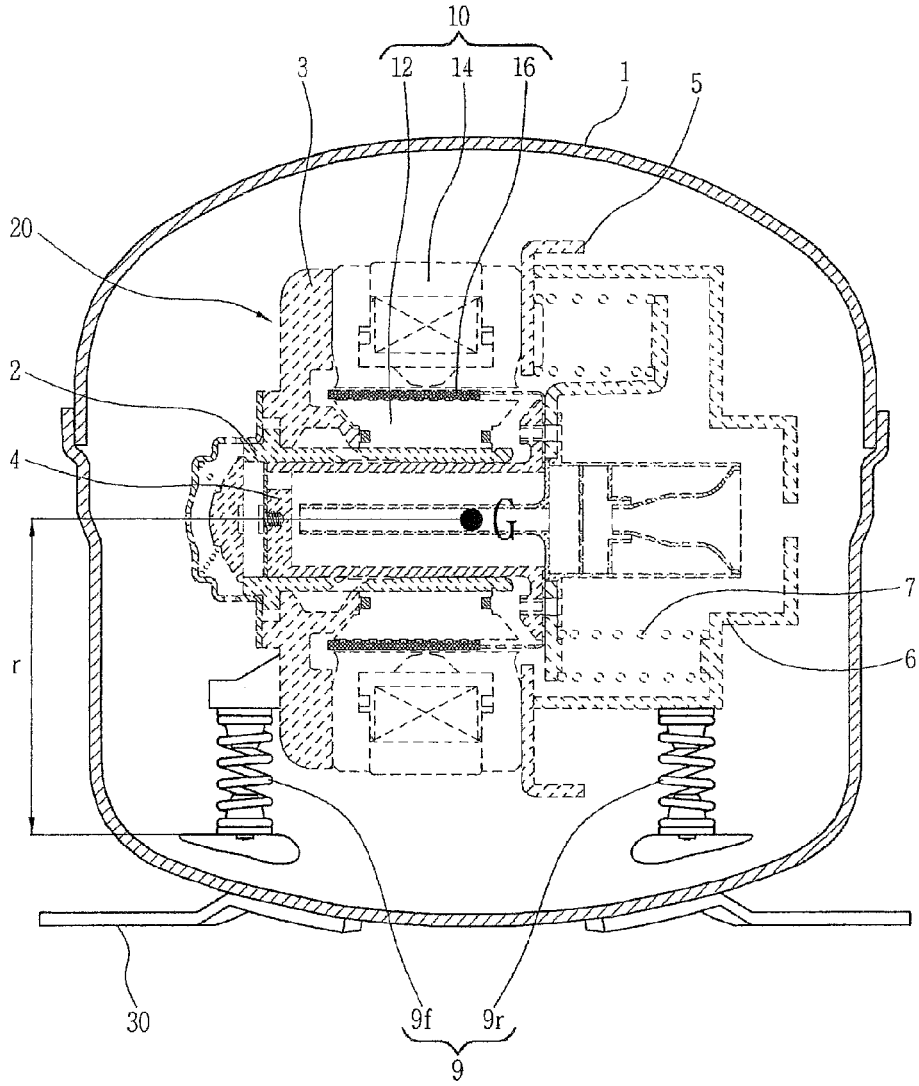
FIG. 2 PRIOR ART
FIG. 2 is a schematic view illustrating a vibration system of a general linear compressor.

FIG. 2 is a schematic view illustrating a vibration system of a linear compressor. A compressor main body 20 is supported by elastic members 9 and accommodated in a shell 1. Referring to FIG. 2, a rotation moment imparted to the elastic members 9 is represented as follows:

$$M(\text{Moment})=m(\text{mass})\times r^2 \qquad \text{Formula (1)}$$

Here, since the elastic members 9 and the compressor main body 20 are coupled to each other, when the elastic members 9 are rotated due to the rotation moment, the compressor main body 20 is relatively rotated with respect to the elastic members 9. Therefore, pitching occurs in the compressor main body 20, thereby generating vibration and noise of the compressor.

In Formula (1), a mass m or a distance r between installation points of bottom ends of the elastic members 9 and a gravity center point G should be reduced to lower the rotation moment imparted to the elastic members 9. At this time, there is a limitation in reducing the mass m of the compressor main body 20. It is not easy to reduce the mass m of the compressor main body 20, either. Accordingly, it is preferable to reduce the distance r between the installation points of the bottom ends of the elastic members 9 and the gravity center point G so as to reduce the rotation moment imparted to the elastic members 9.

Figure 3:
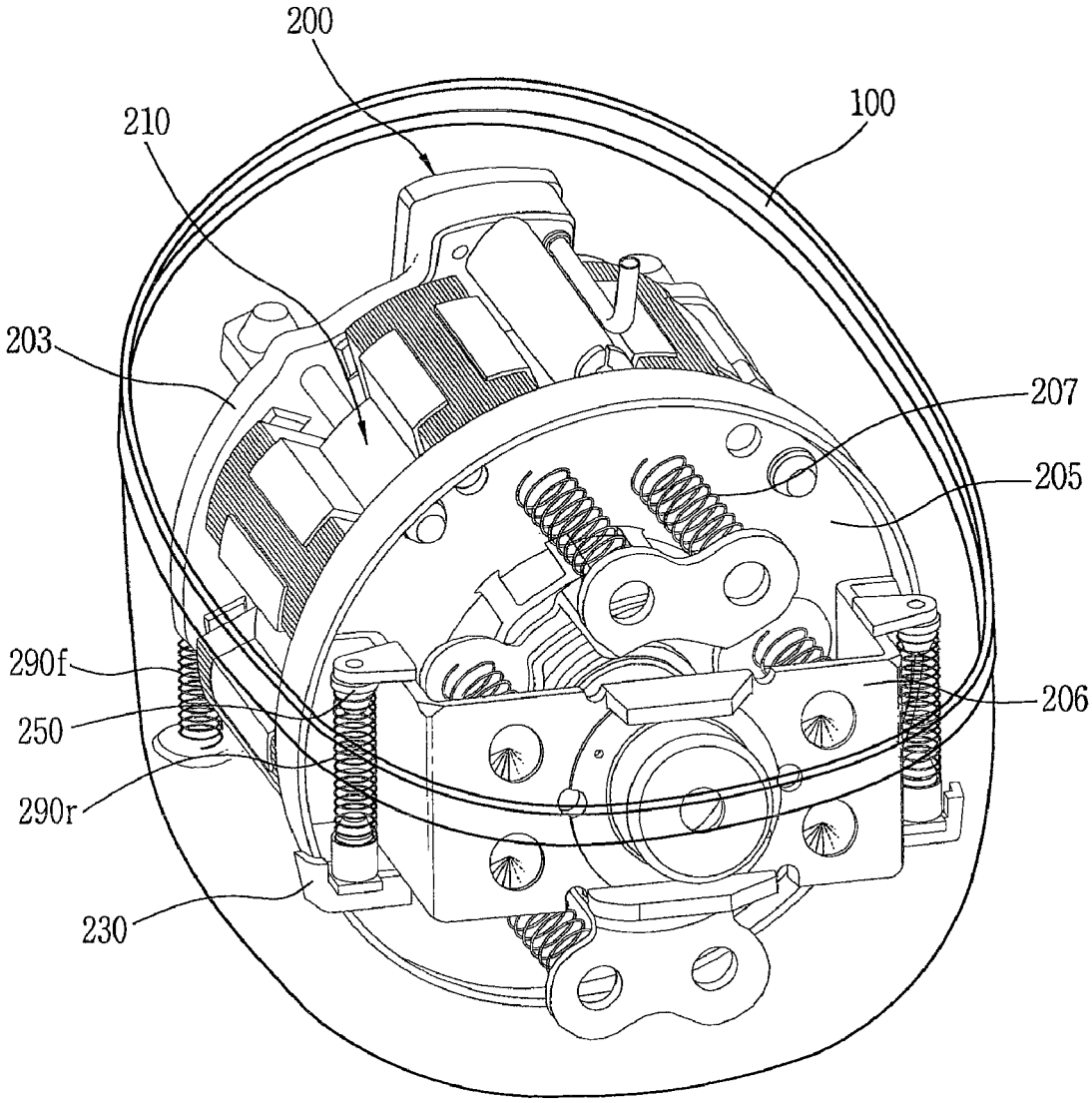
FIG. 3 is a perspective view illustrating a linear compressor according to a first embodiment of the present invention.
Figure 4:
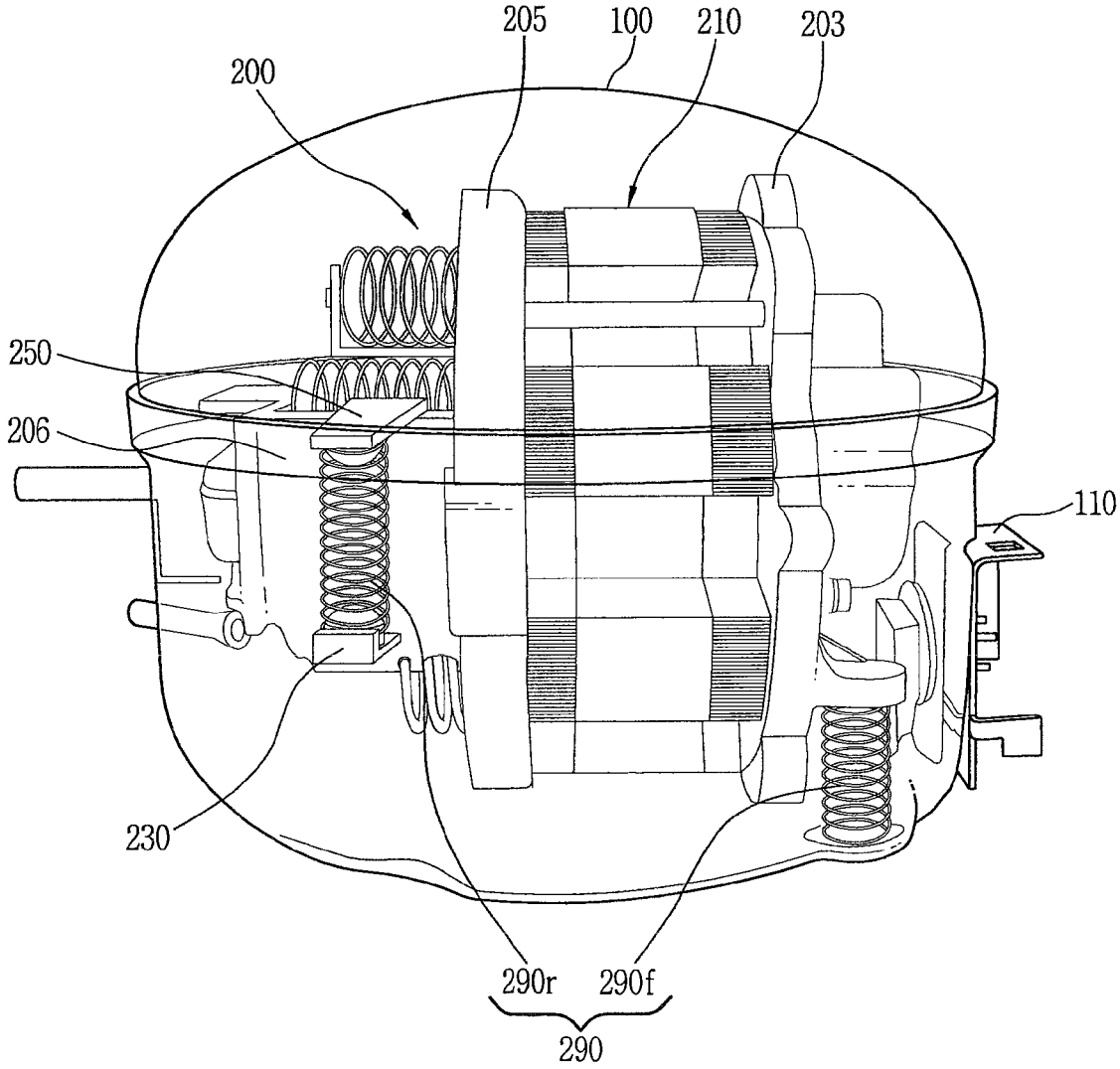
FIG. 4 is a side view illustrating the linear compressor according to the first embodiment of the present invention.

FIGS. 3 and 4 are views illustrating a linear compressor according to a first embodiment of the present invention. In the first embodiment of the present invention, installation positions of rear elastic members are changed.

A compressor main body 200 includes a cylinder (not shown), a piston (not shown), a frame 203, a motor cover 205, a back cover 206 and a linear motor 210. The compressor main body 200 is supported by elastic members 290 and accommodated in a shell 100. The number of the elastic members 290 is four. That is, a pair of front elastic members **290*f* are installed at the front of the compressor main body 200, i.e., on the side of the frame 203 adjacent to a terminal 110 for supplying power to the shell 100, and a pair of rear elastic members 290*r* are installed at the rear of the compressor main body 200, i.e., on the side of the back cover 206**.

Here, the rear elastic members **290*r* are spaced apart from the bottom of the shell 100 by a predetermined distance to reduce a distance r between installation points of bottom ends of the rear elastic members 290*r* and a gravity center point. As the position of the bottom ends of the rear elastic members 290*r* approaches the gravity center point of the compressor main body 200, a rotation moment operating on the rear elastic members 290*r*** is lowered.

A structure of supporting the bottom ends of the rear elastic members **290*r* to be spaced apart from the bottom of the shell 100 is necessary to satisfy the above-described relation between the position of the bottom ends of the rear elastic members 290*r* and the gravity center point. To this end, the linear compressor according to the first embodiment of the present invention includes lower supporters 230 installed on a side surface of the shell 100 to support the bottom ends of the rear elastic members 290*r*. The lower supporters 230 can be implemented into various forms if that have surfaces attached to the side surface of the shell 100 and surfaces supporting the elastic members 290**.

In addition, a structure of connecting the compressor main body 200 to the rear elastic members **290*r* is required so that top ends of the rear elastic members 290*r* can support the compressor main body 200. To this end, the linear compressor according to the first embodiment of the present invention includes upper supporters 250 installed on the side of the compressor main body 200 to constrain the top ends of the rear elastic members 290*r*. The upper supporters 250 can be implemented into various forms to enable the rear elastic members 290*r* to support the compressor main body 200. That is, the upper supporters 250 may include a portion connected to a part of the compressor main body 200, and a portion constraining the rear elastic members 290*r*. In the upper supporters 250 of FIGS. 3 and 4, surfaces constraining the rear elastic members 290*r* are integrally formed with the back cover 206. The surfaces constraining the rear elastic members 290*r* are formed as a part of the back cover 206 and bent from the back cover 206 to constrain the top ends of the rear elastic members 290*r* and to support the compressor main body 200 by the rear elastic members 290*r***.

For another example, the upper supporters 250 may be separately manufactured, some portions thereof may be connected to the compressor main body 200, and the other portions thereof may be connected to the rear elastic members **290*r*. In addition, the upper supporters 250 may be installed on the motor cover 205 and the back cover 206**.

Figure 5:
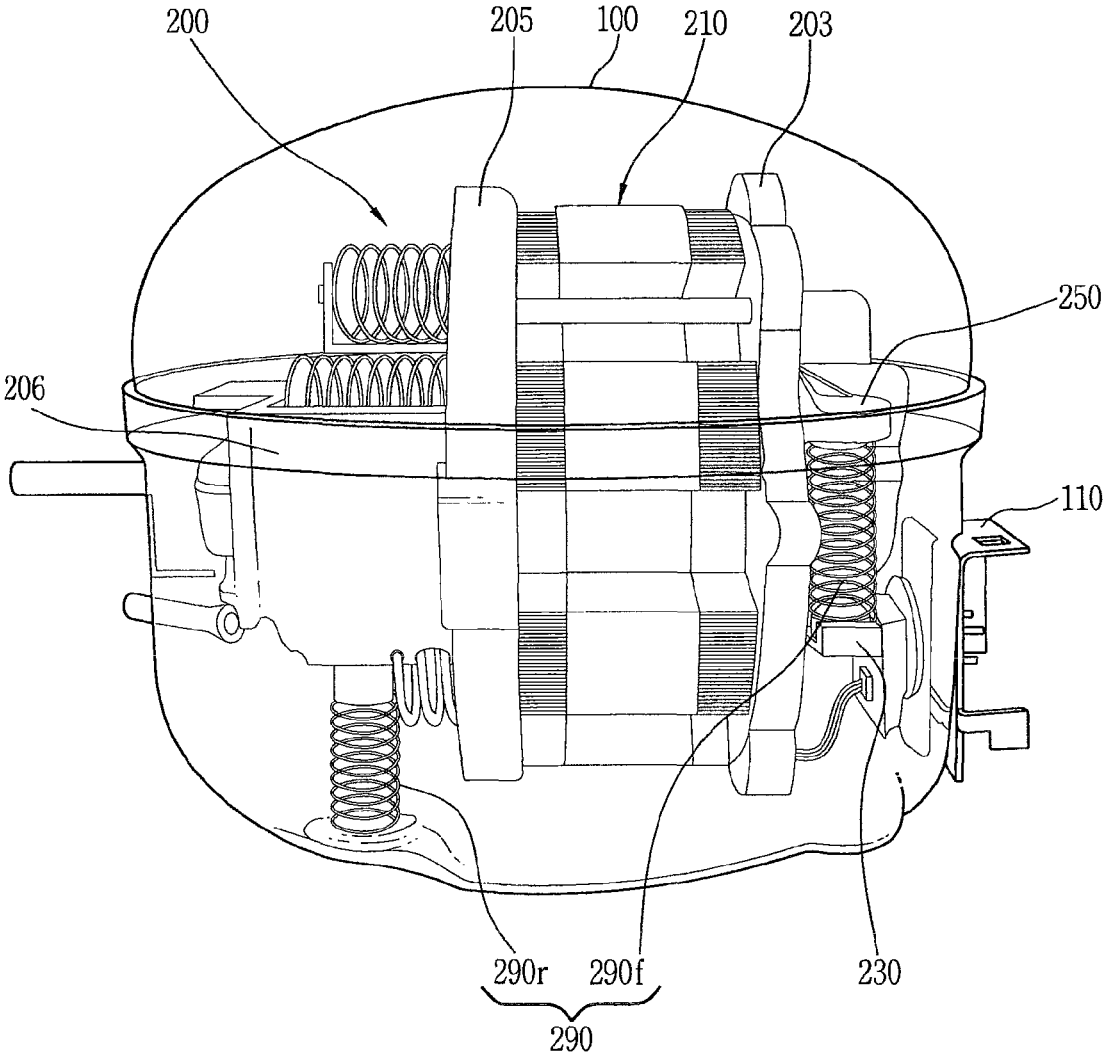
FIG. 5 is a side view illustrating a linear compressor according to a second embodiment of the present invention.

FIG. 5 is a view illustrating a linear compressor according to a second embodiment of the present invention. In the second embodiment of the present invention, installation positions of front elastic members are changed.

Here, front elastic members **290*f* are spaced apart from the bottom of a shell 100 by a predetermined distance to reduce a distance r between installation points of bottom ends of the front elastic members 290*f* and a gravity center point. Lower supporters 230 are installed to support the bottom ends of the front elastic members 290*f*. Some portions of the lower supporters 230 are attached to the inside of the shell 100, and the other portions thereof support the bottom ends of the front elastic members 290*f***.

Moreover, top ends of the front elastic members **290*f* should support a compressor main body 200. Accordingly, upper supporters 250 for constraining the top ends of the front elastic members 290***f* are formed on a frame 203. The upper supporters 250 may be separately manufactured and connected to the frame 203, or may be integrally formed with the frame 203 in manufacturing of the frame 203.

Figure 6:
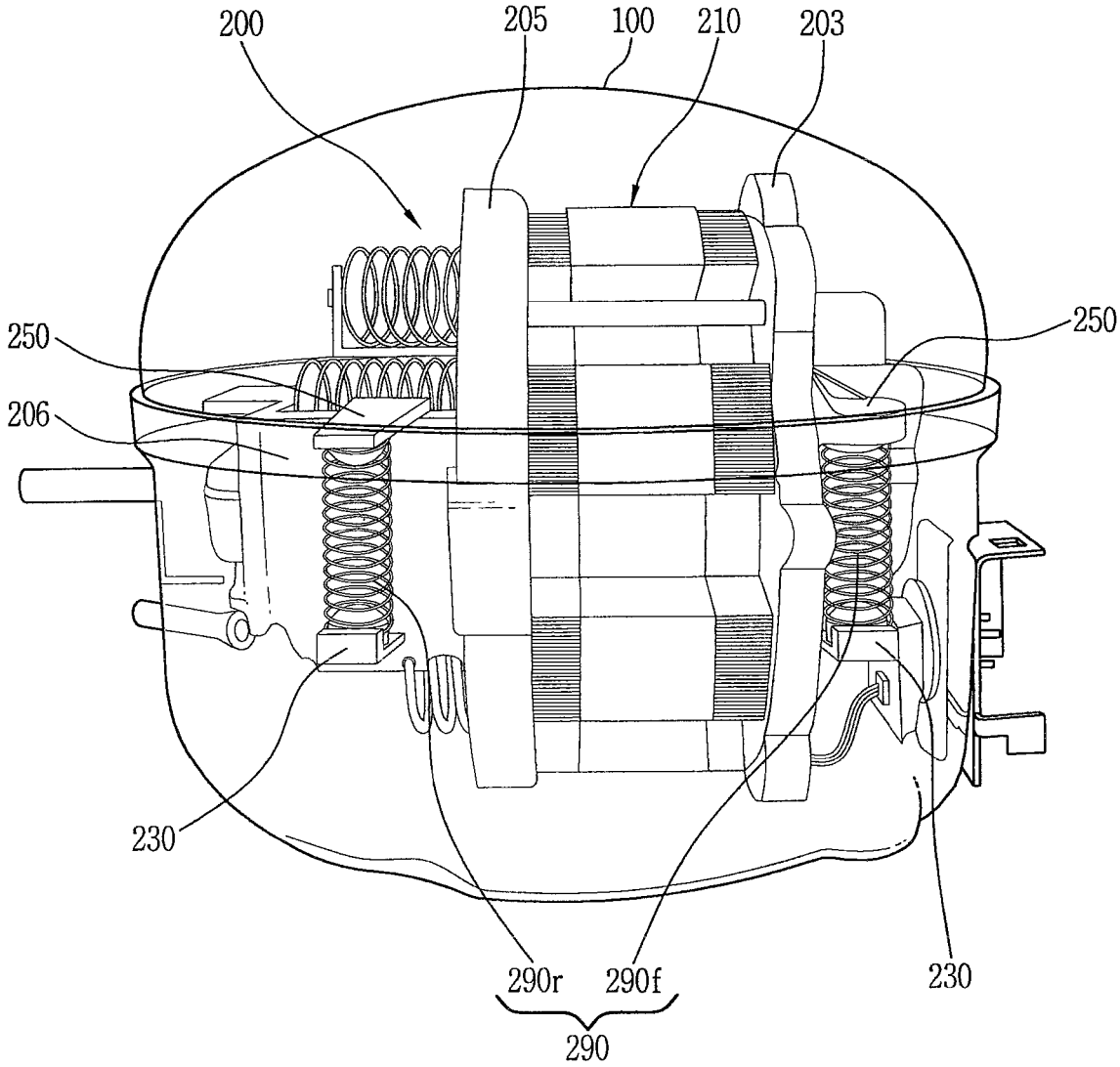
FIG. 6 is a side view illustrating a linear compressor according to a third embodiment of the present invention.

FIG. 6 is a view illustrating a linear compressor according to a third embodiment of the present invention. In the third embodiment of the present invention, both front elastic members 290*f* and rear elastic members 290*r* are spaced apart from the bottom of a shell 100, so that installation points of bottom ends of the elastic members 290 can approach a gravity center point of a compressor main body 200.

The compressor main body 200 is supported by the front elastic members 290*f* and the rear elastic members 290*r*, and spaced apart from the bottom of the shell 100. In addition, the bottom ends of the front elastic members 290*f* and the rear elastic members 290*r* are spaced apart from the bottom of the shell 100. Lower supporters 230 for supporting the bottom ends of the front elastic members 290*f* and the rear elastic members 290*r* respectively are installed on inner sidewalls of the shell 100. Moreover, upper supporters 250 for constraining top ends of the front elastic members 290*f* and the rear elastic members 290*r* respectively are installed on the compressor main body 200.

As compared with when any one of the front elastic members 290*f* and the rear elastic members 290*r* approaches the gravity center point of the compressor main body 200, when both the front elastic members 290*f* and the rear elastic members 290*r* are spaced apart from the bottom of the shell 100 so that the bottom ends thereof can approach the gravity center point of the compressor main body 200, a rotation moment operating on the elastic members 290 can be lowered and pitching of the compressor main body 200 can be suppressed.

The present invention has been described in detail with reference to the embodiments and the attached drawings. However, the scope of the present invention is not limited to these embodiments and drawings, but defined by the appended claims.

INDUSTRIAL APPLICABILITY

The linear compressor according to the present invention can prevent pitching of the compressor main body installed inside the shell.

In addition, the linear compressor according to the present invention can reduce vibration and noise.

Moreover, the linear compressor according to the present invention can reduce vibration transferred to a system with the compressor installed therein, by reducing vibration of the compressor inside the shell by changing the installation structure of the compressor main body.

What is claimed is:

1. A linear compressor, comprising:

a compressor main body including a piston that compresses refrigerant and a linear motor that drives the piston;

a shell that accommodates the compressor main body;

a plurality of elastic members that support the compressor main body inside the shell; and at least one lower supporter spaced apart from a bottom of the shell that supports a bottom end of one of the plurality of elastic members, wherein the plurality of elastic members comprise at least one front elastic member installed at a front of the compressor main body and at least one rear elastic member installed at a rear of the compressor main body, and an installation height of a bottom end of the at least one front elastic member is different from a bottom end of the at least one rear elastic member, wherein the compressor main body comprises a plurality of upper supporters for supporting each top end of the plurality of elastic members, and wherein a height of a gravity center of the compressor main body is positioned between a height of the at least one lower supporter that supports the elastic members having the bottom ends installed in a relatively high position and heights of the upper supporters supporting the elastic members having the bottom ends installed in a relatively high position.

2. The linear compressor of claim 1, wherein any one of the front and rear elastic members is supported by the at least one lower supporter.

3. The linear compressor of claim 1, further comprising a terminal that applies power to the linear motor at a front of the shell, wherein the at least one front elastic member is installed at a front of the compressor main body facing a front of the shell and the at least one rear elastic member is installed at a rear of the compressor main body, and wherein a bottom end of the at least one front elastic member is supported by the bottom of the shell, and a bottom end of the at least one rear elastic member is supported by the at least one lower supporter.

4. The linear compressor of claim 1, wherein the upper supporters that support the elastic members have bottom ends installed in the relatively high position are formed on a back cover.

5. The linear compressor of claim 1, wherein the upper supporters that support the elastic members have bottom ends installed in the relatively high position are formed as a part of a back cover.

6. The linear compressor of claim 1, wherein the upper supporters that support the elastic members having bottom ends installed in the relatively high position are formed on a frame.

7. The linear compressor of claim 1, wherein the upper supporters that support the elastic members having bottom ends installed in the relatively high position are formed as a part of frame.

8. The linear compressor of claim 1, wherein the at least one lower supporter is installed on a side surface of the shell.

9. The linear compressor of claim 1, wherein all of the lower supporters are spaced apart from the bottom of the shell to support bottom ends of the elastic members.

10. A linear compressor, comprising:

a compressor main body including a piston to compress refrigerant and a linear motor to drive the piston;

a shell to accommodate the compressor main body;

a plurality of elastic members to support the compressor main body, wherein the plurality of elastic members include a front elastic member at a front of the compressor main body and a rear elastic member at a rear of the compressor main body;

a plurality of lower supporters spaced from a bottom of the shell and installed to the shell, each to support a bottom end of a respective one of the plurality of elastic members; and a plurality of upper supporters, each to support a top end of a respective one of the plurality of elastic members, and wherein a height of the bottom end of the front elastic member supported by one of the lower supporters is different from a height of the bottom end of the rear elastic member supported by another one of the lower supporters.

11. The linear compressor of claim 10, wherein the front elastic member is at a front of the compressor main body facing a front of the shell and the rear elastic member is at a rear of the compressor main body, and wherein the bottom end of the front elastic member is supported by the bottom of the shell.

12. The linear compressor of claim 10, wherein a height of a gravity center of the compressor main body is positioned between a height of the lower supporter that supports the elastic members having bottom ends installed in a relatively high position and heights of the upper supporters supporting the elastic members having the bottom ends installed in a relatively high position.

13. The linear compressor of claim 10, wherein the upper supporters are formed on a back cover or as a part of the back cover.

14. The linear compressor of claim 10, wherein the upper supporters are formed on a frame or as a part of the frame.

15. The linear compressor of claim 10, wherein one of the lower supporters is installed on a side surface of the shell.

* * * * *